United States Patent [19]

Leersnijder

[11] 3,977,509

[45] Aug. 31, 1976

[54] BAR-CODE WRITER

[75] Inventor: Carolus Pieter Leersnijder, Heemstede, Netherlands

[73] Assignee: De Staat der Nederlanden, te Dezen Vertegenwoordiged Door de Directeur-Generaal der posterijen, Telegrafie en Telefonie, The Hague, Netherlands

[22] Filed: Oct. 17, 1974

[21] Appl. No.: 515,589

[30] Foreign Application Priority Data

Oct. 18, 1973 Netherlands ..... 7314356

[52] U.S. Cl. ..... 197/1 R; 101/93.28; 101/93.33

[51] Int. Cl.[2] ..... B41J 3/04; B41J 9/36

[58] Field of Search ..... 197/1; 101/93.48, 93.28, 101/93.29, 93.30, 93.34, 93.33, 93.35

[56] References Cited

UNITED STATES PATENTS

| | | | |
|---|---|---|---|
| 2,659,652 | 11/1953 | Thompson | 197/1 R |
| 2,737,883 | 3/1956 | Crawford, Jr. | 101/93.33 X |
| 3,188,946 | 6/1965 | Schacht | 101/93.34 |
| 3,218,965 | 11/1965 | Simons et al. | 101/93.35 |
| 3,309,989 | 3/1967 | Solheim et al. | 101/93.34 |
| 3,386,378 | 6/1968 | Bradbury et al. | 101/93.29 X |
| 3,504,623 | 4/1970 | Staller | 101/93.33 |
| 3,507,213 | 4/1970 | Derc | 101/93.33 |
| 3,631,797 | 1/1972 | Johnston et al. | 101/93.48 |
| 3,702,585 | 11/1972 | Landis et al. | 101/93.48 X |
| 3,789,755 | 2/1974 | Gross | 101/95 |
| 3,823,667 | 7/1974 | Babler | 101/93.31 |
| 3,838,638 | 10/1974 | Clary | 101/93.34 |
| 3,842,734 | 10/1974 | Gomi | 101/93.34 |

*Primary Examiner*—Edgar S. Burr
*Assistant Examiner*—Paul J. Hirsch

[57] ABSTRACT

Device for marking or writing a parallel bar code onto a document such as a postal article, comprising a number of parallel separately electromagnetically selected printing-styli and cooperating spring, crank, lever, and stop means for moving the end of each selected stylus toward and across or along the surface of the document to write or mark a bar thereon.

22 Claims, 6 Drawing Figures

BAR-CODE WRITER

BACKGROUND OF THE INVENTION

When *n* parallel bars comprising a code are applied to a document, such as a postal article, the number and the location of the bars indicate the code information. Since these bars are exclusively applied to such documents by means of printing, this method often presents an incomplete print, because one or more bars, which should have been printed in a clearly visible way, are not, or hardly at all, or only partly visible. These errors are often caused by an uneven surface of the documents and by an insufficient supply of printing-ink.

SUMMARY OF THE INVENTION

Generally speaking, the device of the present invention is constructed to solve these problems by providing a number of printing-styli with a printing area which is shorter than the length of a code bar to be printed, so that the printing ends of the styli must be moved with respect to the document in the direction of the length of the bars to be printed. Thus these styli are writing styli instead of of printing stamps; the styli can be sufficiently pressed against the document over the full length of the bars even on an uneven surface of the document.

The means for accomplishing this writing comprises a mechanism which can be driven synchronously with a plate for pressing the documents against an apertured surface, through which aperture the styli can apply the code to the bar document. When a document has arrived in front of the styli, it is pressed against the said surface by the plate. Then the styli that have to form the code at that moment, are pressed against the document, after which the stylus-ends are drawn along the document by the mechanism.

The styli can each be associated with a spring for pushing them towards the documents, and can be held from operation by their springs, by pawls operated by electromagnets. On the other hand, when styli are released by their pawls, the mechanism causes that stylus-end to describe a closed curve. The document, however, prevents the stylus end from completely following the curve determined by the mechanism, so that the curve is flattened as that stylus draws a bar on the document, such as by pressing against an inked ribbon. The curve has such dimensions that a stop on the stylus engages with its pawl again when the stylus motion cycle has been completed and its pawl has been returned to its inoperated position.

According to a preferred embodiment of this invention, the mechanism contains a crank or eccentric, which is coupled to a guide for the stylus-end. The stylus is also provided with a second stop located along the stylus remote from the stylus-end, which stop can co-operate with the pawl for releasing the stylus to be operated by its spring and its guide.

BRIEF DESCRIPTION OF THE VIEWS

The above mentioned and other features, objects and advantages, and the manner of obtaining them are described more specifically below by reference to an embodiment of this invention shown in the accompanying drawings, wherein.

Figure 1:
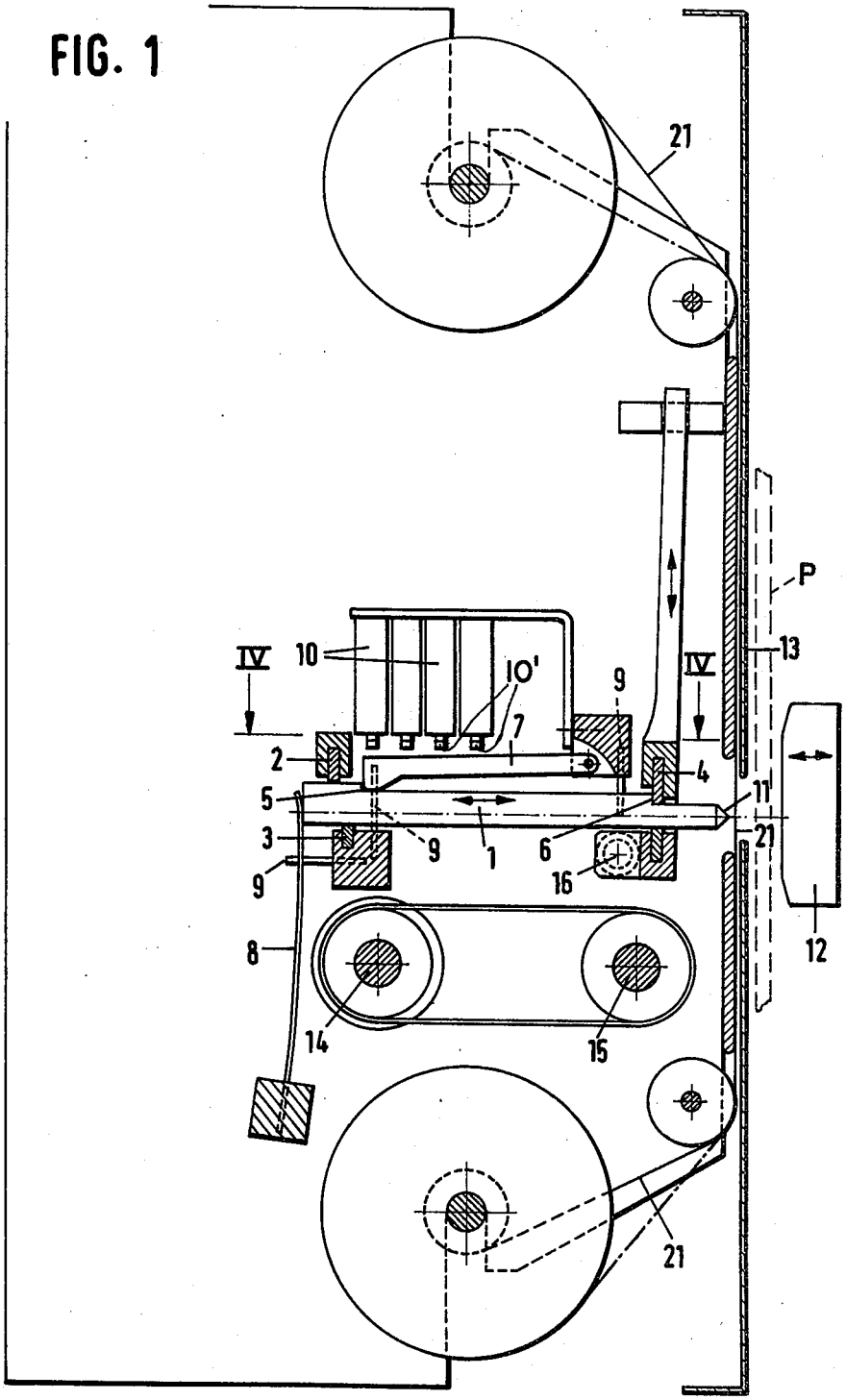
FIG. 1 is a schematic vertical cross-section of a preferred embodiment of this invention including a printing stylus, its guide, and a document.
Figure 2:
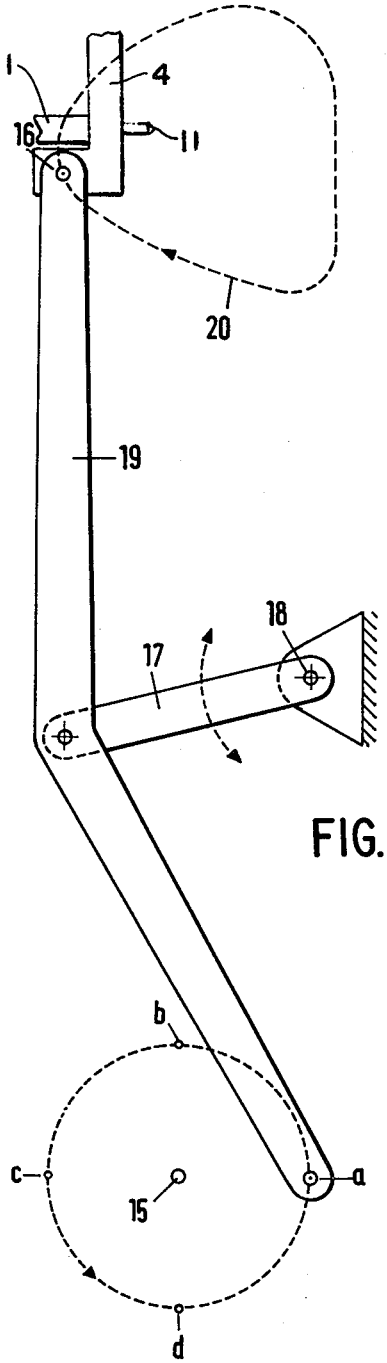
FIG. 2 is a schematic diagram showing the lever mechanism for moving the guide for the stylus shown in FIG. 1.
Figure 2A:
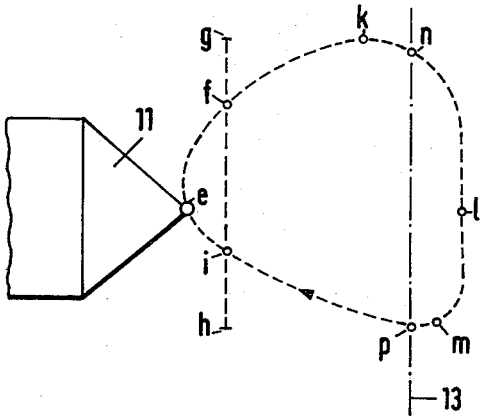
Figure 3:
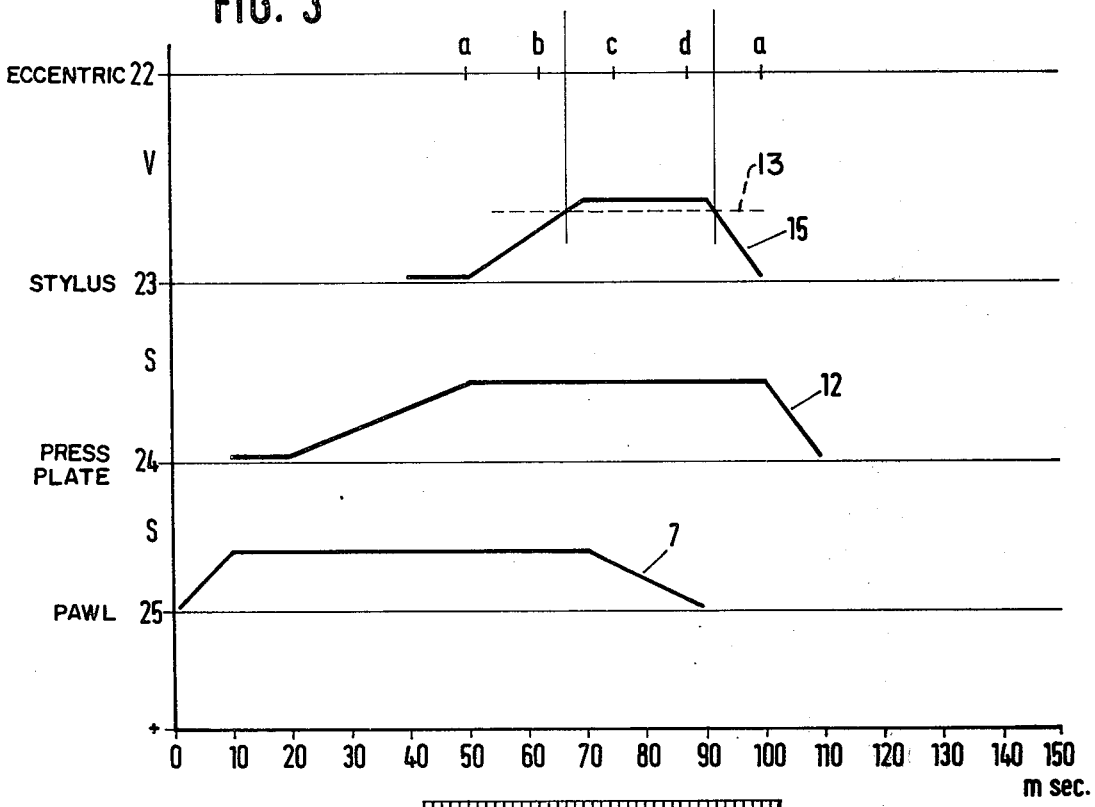
Figure 4:
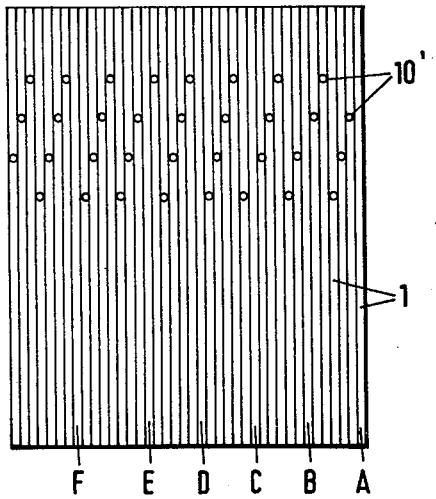
Figure 5:
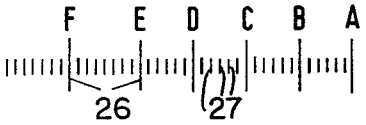

FIG. 2*a* is a schematic diagram of the different paths of motion of the end of the marking stylus shown in FIG. 2, in its operative and inoperative positions;

FIG. 3 is a schematic time diagram showing the operations of the different parts of the mechanism shown in FIGS. 1 and 2 in time relationship with respect to each other;

FIG. 4 is a view taken along line IV—IV of FIG. 1 showing a bank of styli and the poles of their selecting magnets; and FIG. 5 is a schematic view of a bar code produced by the styli shown in FIG. 4.

DETAILED DESCRIPTION OF PREFERRED EMBODIMENT

FIG. 1 represents a movable printing-stylus 1. Seen in the plane of the drawing along line IV—IV, there are 40 of such styli (see FIG. 4), parallel to each other. These printing-styli can move between fixedly mounted guides 2, 3 at their outer ends and a movable guide 4 at their writing ends. The styli 1 are provided with two stops 5, 6. The stop 5 co-operates with a pawl 7, the stop 6 with the guide 4. Each stylus is pressed by a spring 8 toward the document P to be printed. Adjacent springs 8, pawls 7, and styli 1 are separated by spacer pins 9. The pawls 7 can be lifted or operated by electromagnets 10. The stylus-ends 11 have a very small, but not a sharp surface. A pressing plate 12 serves for pressing a document P, against a surface 13 apertured for the styli 1. A mechanism, which is not shown in FIG. 1, ensures the operation of a one-rotation coupling on a driving shaft 14, synchronously with the movement of the pressing plate 12. The driving shaft 14 drives an eccentric shaft or crank 15, which is coupled by means of a lever mechanism (FIG. 2) with a pivot or point 16 connected to the guide 4. The lever mechanism is formed by an arm 17, pivoting on a fixed turning point or pivot 18, and pivoted to an intermediate point on a lever 19. One end of the lever 19 is connected to the pivot 16 and the other end is connected to the crank or eccentric on shaft 15. Thus the point 16 describes a closed curve 20 in the direction of the arrow once in e.g. 50 msec and then stops until initiated again, such as to print another code on another document P. An ink-ribbon 21 is provided between the stylus-ends 11 and the surface 13 for insuring a visible bar mark on the document P by the motion of its styli 1.

The operation of the mechanism is as follows: When a document P is in front of the surface 13 and opposite the stylus-ends 11, it is pressed against the said surface by the plate 12. Now the point 16 (see FIG. 2) describes the curve 20 once. The stylus-end 11 of a stylus 1, when the pawl 7 of which has not been lifted, describes the closed curve and straight line *e - f - g - h - i - e* once (FIG. 2*a*) because the stylus-end 11 cannot reach the surface 13. When, however, an electromagnet 10 has lifted a pawl 7, the spring 8 causes the stylus 1 to follow the whole or full movement of the guide 4. The stylus-end 11 then moves through the aperture in the plate 13 and describes the curve *e - k - l - m - e* in FIG. 2*a*, but it is partly prevented from doing so by the document P against the surface 13. The curve that is now described for the stylus-end 11 is *e - e - n - p - e*, and between the points *n* and *p* the stylus-end draws a bar on the document by means of the ink-ribbon 21. As the curve is continued past the point *i*, the stop 5 near the remote end of stylus 1 engages with its pawl 7 again, because the electromagnet 10 has dropped the pawl 7 in the meantime back into its full line position shown in FIG. 1.

The time diagram of FIG. 3 indicates on its top line 22 the moments point *a* (see FIG. 2) is successively in the positions *a* - *b* - *c* - *d* - *a*. The vertical lines show the limits for the writing or marking time of the stylus-ends 11. The line 23 represents a speed-time diagram of crank shaft 15. The lines 24 and 25 represent a deviation-time diagram of press plate 12, and the pawls 7, respectively.

FIG. 4 shows the arrangement of the cores 10' of the electromagnets 10 along the styli 1 seen from above in the direction of the arrows IV—IV with the omission of the spacer pins 9, springs 8, and guides 4.

FIG. 5 shows a code pattern. The positions A, B, C, D, E, F have always to get a pivoted bar 26 because in these positions the magnets 10 and the pawls 7 have been omitted so that they always print on the document P. Consequently, there remains thirty-four electromagnets and selectable styli to be operated. Between the fixed positions A, B, C, D and E there are always five code positions available, and seven code positions on either side of the fixed position F, so that there are 40 styli in all. The code pattern according to FIG. 5 can be completed by energizing the electromagnets 10, as a result of which bars are drawn in the corresponding code positions on the document P. These bars are similar to the bars 26 shown drawn in the positions A – F, but for the sake of clearness they are indicated by short bars 27 in FIG. 5.

While there is described above the principles of this invention in connection with specific apparatus, it is to be clearly understood that this description is made only by way of example and not as a limitation to the scope of this invention.

What is claimed is:

1. A mechanism for marking a bar code on a document comprising:

A. an apertured surface,

B. means for pressing one side of said document against said apertured surface to hold it stationary with respect to said apertured surface, C. stylus means for marking the other side of said document through the aperture, and D. means to move said stylus means towards and into contact with the other side of said document and subsequently along the surface of said other side of said document while in contact therewith to mark a bar thereon.

2. A mechanism according to claim 1 including a plurality of said stylus means parallel to each other.

3. A mechanism according to claim 2 wherein means to move said stylus means includes means for moving all said plurality of styli means.

4. A mechanism according to claim 2 including means for separately operating predetermined ones of stylus means by said moving means for marking bars on said document.

5. A mechanism according to claim 4 wherein said selecting means comprise electromagnets.

6. A mechanism according to claim 1 wherein said means for moving said stylus means towards said document comprises a resilient means.

7. A mechanism according to claim 1 wherein said means for moving said stylus means along said document comprises a crank and lever means.

8. A mechanism according to claim 1 including means for imparting an ink to said document located between the marking end of said stylus and said document.

9. A mechanism according to claim 1 wherein said stylus means includes a stop means engagable by said moving means.

10. A mechanism according to claim 1 wherein said moving means includes a pawl for engaging said stylus means.

11. A mechanism according to claim 1 wherein said moving means comprises a spring, crank and lever mechanism for moving the marking end of said stylus means in a closed loop path perpendicular to said other side of said document.

12. A mechanism according to claim 1 wherein said loop path is flattened by contact of said marking-end of said stylus by said other side of said document.

13. A mechanism according to claim 1 including stop means on said stylus means for restricting the motion of said stylus in said closed loop path.

14. A mechanism according to claim 13 including pawl means for disengaging said stop means.

15. A mechanism for printing a bar code on a document comprising:

A. an apertured plate,

B. means to hold said document stationary against said apertured plate,

C. a plurality of styli means each separately movable towards and into contact with one side of said document and subsequently along said document while in contact therewith to write a bar thereon, D. crank and lever means for moving all of said styli means, E. movable stop means for restricting the full movement of said styli means towards said document, and F. separate electromagnetic means for a plurality of said styli means for selecting said styli means for writing said bars on said document by release of said stop means.

16. A mechanism according to claim 15 including ink transferring means between said styli means and the said document.

17. A mechanism according to claim 15 wherein said styli means are arranged parallel to each other.

18. A mechanism according to claim 15 including resilient means for urging said styli means towards said document.

19. A mechanism according to claim 15 wherein said crank and lever means move the marking ends of said styli means in a closed loop path.

20. A mechanism according to claim 15 wherein the marking end of said styli means has an area less than the area of the bar written on said document.

21. A mechanism according to claim 15 wherein said movable stop means comprises pawls engagable with stops on said styli means.

22. A mechanism according to claim 15 wherein said means for moving said styli means includes stop means on said styli means.

* * * * *

PO-1050
(5/69)

UNITED STATES PATENT OFFICE
CERTIFICATE OF CORRECTION

Patent No. 3,977,509 Dated August 31, 1976

Inventor(s) Carolus Pieter LEERSNIJDER

It is certified that error appears in the above-identified patent and that said Letters Patent are hereby corrected as shown below:

| | |
|---|---|
| Column 1, line 33 | before "code" insert - - bar - - |
| | cancel "bar" after "the" |
| Column 2, line 67 | change second "e" to - - k - - |

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*